US009714518B2

(12) United States Patent
Gopalan et al.

(10) Patent No.: US 9,714,518 B2
(45) Date of Patent: Jul. 25, 2017

(54) DEBRIS BAG WITH DETACHABLE COLLAR

(71) Applicant: Pentair Water Pool and Spa, Inc., Sanford, NC (US)

(72) Inventors: Suresh C. Gopalan, Milpitas, CA (US); Jayamurali Kaladharan, Nagapattinam (IN)

(73) Assignee: Pentair Water Pool and Spa, Inc., Cary, NC (US)

( * ) Notice: Subject to any disclaimer, the term of this patent is extended or adjusted under 35 U.S.C. 154(b) by 6 days.

(21) Appl. No.: 14/996,108

(22) Filed: Jan. 14, 2016

(65) Prior Publication Data

US 2016/0199759 A1 Jul. 14, 2016

Related U.S. Application Data

(60) Provisional application No. 62/103,481, filed on Jan. 14, 2015.

(51) Int. Cl.
*E04H 4/16* (2006.01)

(52) U.S. Cl.
CPC ..... *E04H 4/16* (2013.01); *E04H 4/1654* (2013.01)

(58) Field of Classification Search
CPC ..... E04H 4/16; E04H 4/1654
USPC ..... 210/167.16, 167.17, 232, 448, 416.2; 15/1.7
See application file for complete search history.

(56) References Cited

U.S. PATENT DOCUMENTS

| | | | |
|---|---|---|---|
| 1,184,485 | A | 5/1916 | Mummert |
| 1,302,886 | A | 5/1919 | Wagner |
| 1,383,612 | A | 7/1921 | Evancho |
| 1,383,615 | A | 7/1921 | Geier |
| 1,422,105 | A | 7/1922 | Kirby |
| 1,444,165 | A | 2/1923 | Clements |
| 1,532,975 | A | 4/1925 | Anderson |
| 1,553,076 | A | 9/1925 | Halsted |
| 1,827,496 | A | 10/1931 | Vanderwilt |
| 1,923,299 | A | 8/1933 | Darling |
| 1,970,190 | A | 8/1934 | Riebel |
| 2,003,720 | A | 6/1935 | Walton |
| 2,024,143 | A | 12/1935 | Cameron |
| 2,047,735 | A | 7/1936 | Hunsdorf |
| 2,421,067 | A | 5/1947 | Howe |
| 2,528,332 | A | 10/1950 | Bergquist |
| 2,637,409 | A | 5/1953 | Turner et al. |
| 2,698,638 | A | 1/1955 | James |
| 2,698,639 | A | 1/1955 | Bottomley |
| 2,705,054 | A | 3/1955 | Swann |
| 2,843,309 | A | 7/1958 | Wheeler |
| 2,853,308 | A | 9/1958 | Schramm |

(Continued)

FOREIGN PATENT DOCUMENTS

| | | |
|---|---|---|
| AU | 1703534 | 4/1935 |
| AU | 1985047578 | 5/1986 |

(Continued)

*Primary Examiner* — Fred Prince

(74) *Attorney, Agent, or Firm* — Quarles & Brady LLP

(57) ABSTRACT

Embodiments of the invention provide a debris bag and a collar for a pool cleaner. The debris bag includes a body defined by two opposing sheets of filtration media that are joined together to form an interior compartment. A neck portion extends downwardly from the sheets. A support ring is disposed adjacent the bottom end of the neck portion and an orientation tab extends upwardly from the support ring toward the interior compartment.

20 Claims, 11 Drawing Sheets

(56) References Cited

U.S. PATENT DOCUMENTS

| | | | |
|---|---|---|---|
| 2,989,185 | A | 6/1961 | Lombardi |
| 3,176,450 | A | 4/1965 | Weinstein |
| 3,251,390 | A | 5/1966 | Evans |
| 3,297,152 | A | 1/1967 | Corella et al. |
| 3,367,485 | A | 2/1968 | Schneider |
| 3,426,510 | A | 2/1969 | Schaaf |
| 3,542,206 | A | 11/1970 | Geister |
| 3,722,686 | A | 3/1973 | Arnett et al. |
| 3,767,055 | A | 10/1973 | Flatland |
| 3,822,754 | A | 7/1974 | Henkin et al. |
| 3,827,467 | A | 8/1974 | Henley et al. |
| 3,912,140 | A | 10/1975 | Franges |
| 3,932,281 | A | 1/1976 | Pansini |
| 3,936,899 | A | 2/1976 | Henkin et al. |
| 3,972,339 | A | 8/1976 | Henkin et al. |
| 4,040,864 | A | 8/1977 | Steeves |
| 4,074,869 | A | 2/1978 | Johnson |
| 4,140,163 | A | 2/1979 | Usner |
| 4,296,529 | A | 10/1981 | Brown |
| 4,344,274 | A | 8/1982 | Heismann |
| 4,498,190 | A | 2/1985 | Garlick |
| 4,503,559 | A | 3/1985 | Warnke |
| D279,227 | S | 6/1985 | Price |
| 4,558,479 | A | 12/1985 | Greskovics et al. |
| 4,575,423 | A | 3/1986 | Alanis et al. |
| 4,585,423 | A | 4/1986 | Kwan |
| 4,586,913 | A | 5/1986 | Nagano |
| 4,589,986 | A | 5/1986 | Greskovics et al. |
| 4,618,420 | A | 10/1986 | Alanis |
| 4,630,312 | A | 12/1986 | Milstein |
| D288,373 | S | 2/1987 | Alanis |
| 4,649,589 | A | 3/1987 | Dibb |
| 4,675,032 | A | 6/1987 | Genovese et al. |
| D294,963 | S | 3/1988 | Alanis et al. |
| 4,746,424 | A | 5/1988 | Drew |
| 4,776,954 | A | 10/1988 | Brooks |
| 4,778,599 | A | 10/1988 | Brooks |
| 4,784,171 | A | 11/1988 | Campbell |
| 4,839,062 | A | 6/1989 | Sanders |
| 4,839,063 | A | 6/1989 | Brooks |
| 4,856,913 | A | 8/1989 | Campbell |
| 4,880,531 | A | 11/1989 | Blake et al. |
| 4,889,622 | A | 12/1989 | Newcombe-Bond |
| D310,774 | S | 9/1990 | Collins et al. |
| D311,796 | S | 10/1990 | Collins |
| 5,003,758 | A | 4/1991 | Bernstein |
| 5,031,277 | A | 7/1991 | Coker |
| 5,077,853 | A | 1/1992 | Campbell |
| 5,088,667 | A | 2/1992 | Olson |
| 5,135,647 | A | 8/1992 | Childers |
| 5,172,181 | A | 12/1992 | Morbieu et al. |
| 5,173,181 | A | 12/1992 | McFarland |
| 5,240,484 | A | 8/1993 | Genovese et al. |
| 5,243,809 | A | 9/1993 | Redding |
| 5,330,080 | A | 7/1994 | O'Connor |
| 5,336,403 | A | 8/1994 | Marbach |
| 5,370,597 | A | 12/1994 | Genovese et al. |
| 5,417,495 | A | 5/1995 | Branson |
| 5,450,644 | A | 9/1995 | Berman |
| 5,536,397 | A | 7/1996 | D'Offay |
| D376,450 | S | 12/1996 | Campbell et al. |
| 5,603,135 | A | 2/1997 | Jones et al. |
| D379,693 | S | 6/1997 | Campbell et al. |
| 5,670,118 | A | 9/1997 | Sponholtz |
| 5,760,118 | A | 6/1998 | Sinclair et al. |
| 5,770,532 | A | 6/1998 | Fleissner |
| 5,771,532 | A | 6/1998 | Munnoch |
| 5,813,092 | A | 9/1998 | Greenfield et al. |
| 5,863,425 | A | 1/1999 | Herlehy et al. |
| 5,893,188 | A | 4/1999 | Campbell et al. |
| D409,341 | S | 5/1999 | Van Etten et al. |
| 5,919,359 | A | 7/1999 | Bisseker |
| 5,933,899 | A | 8/1999 | Campbell et al. |
| 5,996,906 | A | 12/1999 | Cooper |
| 6,003,184 | A | 12/1999 | Campbell et al. |
| 6,027,641 | A | 2/2000 | Spradbury et al. |
| 6,035,879 | A | 3/2000 | Campbell et al. |
| 6,041,453 | A | 3/2000 | Barrow et al. |
| 6,071,322 | A | 6/2000 | Hulthen |
| 6,090,219 | A | 7/2000 | Henkin et al. |
| D429,393 | S | 8/2000 | Rief et al. |
| 6,099,091 | A | 8/2000 | Campbell |
| 6,131,227 | A | 10/2000 | Rief et al. |
| 6,158,464 | A | 12/2000 | Campbell et al. |
| 6,169,045 | B1 | 1/2001 | Pike et al. |
| 6,193,885 | B1 | 2/2001 | Campbell |
| D438,373 | S | 3/2001 | Riley |
| 6,241,899 | B1 | 6/2001 | Ramos |
| 6,292,970 | B1 | 9/2001 | Rief et al. |
| 6,302,277 | B1 | 10/2001 | Resh |
| 6,357,478 | B1 | 3/2002 | Campbell |
| 6,358,410 | B1 | 3/2002 | Lambert |
| 6,379,542 | B1 | 4/2002 | Campbell |
| D468,067 | S | 12/2002 | Stoltz et al. |
| D471,330 | S | 3/2003 | Campbell |
| 6,706,175 | B1 | 3/2004 | Rief et al. |
| D489,150 | S | 4/2004 | Campbell |
| 6,740,233 | B2 | 5/2004 | Stoltz et al. |
| 6,782,578 | B1 | 8/2004 | Rief et al. |
| 6,786,947 | B2 | 9/2004 | Mountford |
| 6,802,879 | B2 | 10/2004 | Scanlon |
| 6,802,963 | B2 | 10/2004 | Campbell |
| 6,854,148 | B1 | 2/2005 | Rief et al. |
| 6,908,550 | B2 | 6/2005 | Silverstein |
| 7,029,583 | B2 | 4/2006 | Meritt-Powell |
| 7,208,083 | B2 | 4/2007 | Meritt-Powell |
| 7,273,546 | B2 | 9/2007 | Meritt-Powell |
| 7,472,807 | B1 | 1/2009 | Black |
| 7,507,332 | B2 | 3/2009 | Henkin et al. |
| 7,575,675 | B2 | 8/2009 | Gopalan |
| 2003/0070980 | A1 | 4/2003 | Ray |
| 2004/0007522 | A1 | 1/2004 | Garti |
| 2004/0047522 | A1 | 3/2004 | Thibault |
| 2004/0089593 | A1 | 5/2004 | Campbell |
| 2005/0029177 | A1 | 2/2005 | Peterson et al. |
| 2005/0040089 | A1 | 2/2005 | Meritt-Powell |
| 2005/0155655 | A1 | 7/2005 | Campbell et al. |
| 2005/0236310 | A1 | 10/2005 | Meritt-Powell |
| 2005/0279682 | A1 | 12/2005 | Davidson et al. |
| 2007/0047522 | A1 | 3/2007 | Jefferson et al. |
| 2007/0289906 | A1 | 12/2007 | Gopalan |
| 2008/0019618 | A1 | 1/2008 | Dayton et al. |
| 2008/0029177 | A1 | 2/2008 | Kamiyama et al. |
| 2008/0124791 | A1 | 5/2008 | Bucci |
| 2008/0202997 | A1 | 8/2008 | Davidson et al. |
| 2008/0264029 | A1 | 10/2008 | Sepaniak |
| 2009/0301955 | A1 | 12/2009 | Gopalan |
| 2011/0278210 | A1 | 11/2011 | Gopalan et al. |
| 2012/0152316 | A1 | 6/2012 | Fischer et al. |
| 2013/0152316 | A1 | 6/2013 | Rief et al. |
| 2014/0042063 | A1 | 2/2014 | Rief |

FOREIGN PATENT DOCUMENTS

| | | |
|---|---|---|
| AU | 571737 | 4/1988 |
| AU | 576547 | 9/1988 |
| AU | 586208 | 7/1989 |
| AU | 646056 | 2/1994 |
| AU | 199937936 | 1/2000 |
| AU | 2003200301 | 8/2003 |
| AU | 2005200122 | 8/2005 |
| AU | 2005200432 | 8/2005 |
| AU | 2005204246 | 3/2006 |
| AU | 2006233248 | 5/2007 |
| AU | 2006235806 | 5/2007 |
| AU | 2005239668 | 6/2007 |
| AU | 2007244852 | 11/2007 |
| AU | 2007261424 | 12/2007 |
| AU | 2007261425 | 12/2007 |
| AU | 2006350955 | 5/2008 |
| AU | 2007332716 | 6/2008 |
| AU | 2007332769 | 6/2008 |
| AU | 2008312342 | 4/2009 |
| AU | 2008319307 | 5/2009 |

(56) References Cited

FOREIGN PATENT DOCUMENTS

| | | |
|---|---|---|
| AU | 2008357276 | 12/2009 |
| AU | 2009302593 | 4/2010 |
| AU | 2011244897 | 5/2012 |
| AU | 2012203886 | 7/2012 |
| AU | 2012244365 | 11/2012 |
| AU | 2012258346 | 12/2012 |
| AU | 2013204976 | 5/2013 |
| AU | 2013200894 | 9/2013 |
| AU | 2013266997 | 1/2014 |
| AU | 2014200515 | 2/2014 |
| AU | 2014202995 | 6/2014 |
| AU | 2014202996 | 6/2014 |
| AU | 2014208211 | 8/2014 |
| AU | 2014218432 | 3/2015 |
| CA | 1135012 | 11/1982 |
| CA | 1251004 | 3/1989 |
| CA | 1259459 | 9/1989 |
| CA | 2234825 | 4/1997 |
| CA | 2258842 | 12/1997 |
| CA | 2260903 | 12/1998 |
| DE | 10159354 | 11/2002 |
| EP | 0969167 | 1/2001 |
| ES | 2389483 | 10/2012 |
| GB | 1199886 | 7/1970 |
| GB | 1459853 | 12/1976 |
| GB | 2420116 | 5/2006 |
| JP | 61134413 | 6/1986 |
| JP | 09272601 | 10/1997 |
| JP | 2000042324 | 2/2000 |
| NZ | 239016 | 3/1993 |
| WO | 200021639 | 4/2000 |
| WO | 200238238 | 5/2002 |
| WO | 2005019565 | 3/2005 |
| WO | 2008073329 | 6/2008 |
| WO | 2009052412 | 4/2009 |
| WO | 2009058297 | 5/2009 |
| WO | 2009146479 | 12/2009 |
| WO | 2010042406 | 4/2010 |
| WO | 2010088619 | 8/2010 |
| WO | 20111041444 | 4/2011 |
| WO | 20111063463 | 6/2011 |
| WO | 2011088493 | 7/2011 |
| WO | 2012037435 | 3/2012 |
| WO | 2012078862 | 6/2012 |
| WO | 2013052351 | 4/2013 |
| WO | 2013052352 | 4/2013 |
| WO | 2013057479 | 4/2013 |
| WO | 2013067206 | 5/2013 |
| WO | 2013052356 | 11/2013 |
| ZA | 8606841 | 6/1988 |
| ZA | 8901785 | 11/1989 |
| ZA | 9105471 | 1/1993 |
| ZA | 19959993 | 11/1995 |
| ZA | 9509103 | 5/1996 |
| ZA | 9605947 | 1/1997 |
| ZA | 9709845 | 5/1998 |
| ZA | 19986933 | 8/1998 |
| ZA | 9907765 | 6/2000 |
| ZA | 200100202 | 7/2001 |
| ZA | 200107604 | 3/2002 |
| ZA | 200107605 | 3/2002 |

DEBRIS BAG WITH DETACHABLE COLLAR

RELATED APPLICATIONS

This application claims priority under 35 U.S.C. §119 to U.S. Provisional Patent Application No. 62/103,481 filed on Jan. 14, 2015, the entire contents of which are incorporated herein by reference.

BACKGROUND

Some pool cleaners include a debris bag to hold captured debris. There are different ways of connecting the debris bags to the pool cleaners. Some of the common attachment structures disclosed in the prior art have significant drawbacks because of potential difficulties of correctly attaching a debris bag to a pool cleaner, or costs associated with the replacement of worn or damaged debris bags. One known style of debris bag includes a mesh bag permanently attached to a collar. The collar is designed to attach to the pool cleaner so that the debris bag is in communication with the pool cleaner and secure during the cleaning process. When the debris bag becomes worn, it must be replaced. Therefore, during replacement, both the debris bag and collar must be disposed of due to the permanent nature of the attachment. Furthermore, permanently attached collars are subject to wear and damage. Should a collar need to be replaced, the permanently attached bag that is not worn or damaged is replaced as well. Both scenarios may result in increased expense because of replacing parts that are still functional.

Other known debris bags are connected to collars that require the opening of the debris bag to be captured between the collar and an outlet of the pool cleaner. These attachment structures can be complicated or difficult to perform. If a user does not correctly attach the debris bag, it may separate as the flow of water works against debris collecting in the bag. One example of a complicated connection involves pulling the open end of a debris bag through the attachment collar and over the outlet of the pool cleaner. The user then must hold the debris bag in place over the outlet while attaching the collar to the outlet to capture the open end between the outlet and the collar.

Another prior art example includes a flexible internal collar that has a split portion. The collar is sized to fit around the outlet of the pool cleaner such that the outlet forces the split portion open. The debris bag includes opposed interlocking fasteners (e.g., hook and loop strips) positioned on the outside of the debris bag across the split portion. The debris bag is attached to the cleaner by sliding the collar down over the pool cleaner outlet and securing the interlocking fasteners such that the split portion is collapsed and the collar forms a friction seal around the pool cleaner outlet. This way of connecting the debris bag requires the user to ensure that the connection is tight enough so as to not allow the debris bag to separate from the pool cleaner.

A debris bag having a separable collar that is not complicated or difficult to attach to the pool cleaner would allow the user to dispose of the debris bag or collar as needed. The releasable assembly disclosed herein may result in users saving money by allowing them to reuse the collar, while at the same time preventing unnecessary waste from going into the environment. Additionally, in some instances, a user may have multiple debris bags. When a first bag is filled with debris, the user may replace it with a second, empty bag. A debris bag with an attachable collar would allow for the pool cleaner to keep operating using the second debris bag while the user has the ability to empty the first debris bag at his/her convenience.

Other advantages of the type of attachment disclosed in the present application include providing flexibility to the user while minimizing the replacement cost. A user may have different sizes of debris bags for use depending on the amount of debris in the pool. A smaller debris bag may be easier to empty and allow the pool cleaner to move faster because of reduced drag caused by the debris bag. The relationship between the bag and the pool cleaner may be advantageous for cleaning a pool in minimal time when there is minimal debris to be cleaned. Further, debris bags may have different types of materials for retaining different types of debris. For example, a large or coarse filter media material debris bag may be used when large debris, such as leaves, are in the pool. Other times, a smaller or finer filter media material debris bag may be more effective. The flexibility of using different debris bags with the same collar because of the presently disclosed attachment structure has the potential to impact the time it takes to clean the pool, which could affect the cost of operating the pool and the convenience to the operator in performing the required pool maintenance.

SUMMARY

Some embodiments provide a debris bag for a pool cleaner. The debris bag includes a body defined by two opposing sheets of filtration media that are joined together to form an interior compartment. A neck portion extends downwardly from the sheets and a support ring is disposed adjacent a bottom end of the neck portion. An orientation tab extends upwardly from the support ring toward the interior compartment. Other embodiments include a detachable collar designed to be used with a debris bag.

Other embodiments include a debris bag assembly for a pool cleaner that includes a debris bag and a collar. The debris bag has a body defined by filtration media that forms an interior compartment, and a neck portion having a support ring. The collar is defined by a sidewall having a groove and a plurality of protrusions on an interior surface, wherein the groove receives the support ring of the debris bag and the plurality of protrusions contact the support ring to couple the debris bag to the collar.

Further embodiments include a method of attaching a debris bag to a collar. The method includes the step of providing the debris bag with a body having an upper edge, and a neck portion with a support ring. A collar has a sidewall with a lower edge, and a groove. A plurality of protrusions are disposed on an interior surface of the sidewall. The upper edge of the debris bag is positioned adjacent the lower edge of the collar, and the debris bag is pulled through the collar until the support ring rides over the plurality of protrusions and contacts the groove.

DETAILED DESCRIPTION

Figure 1:
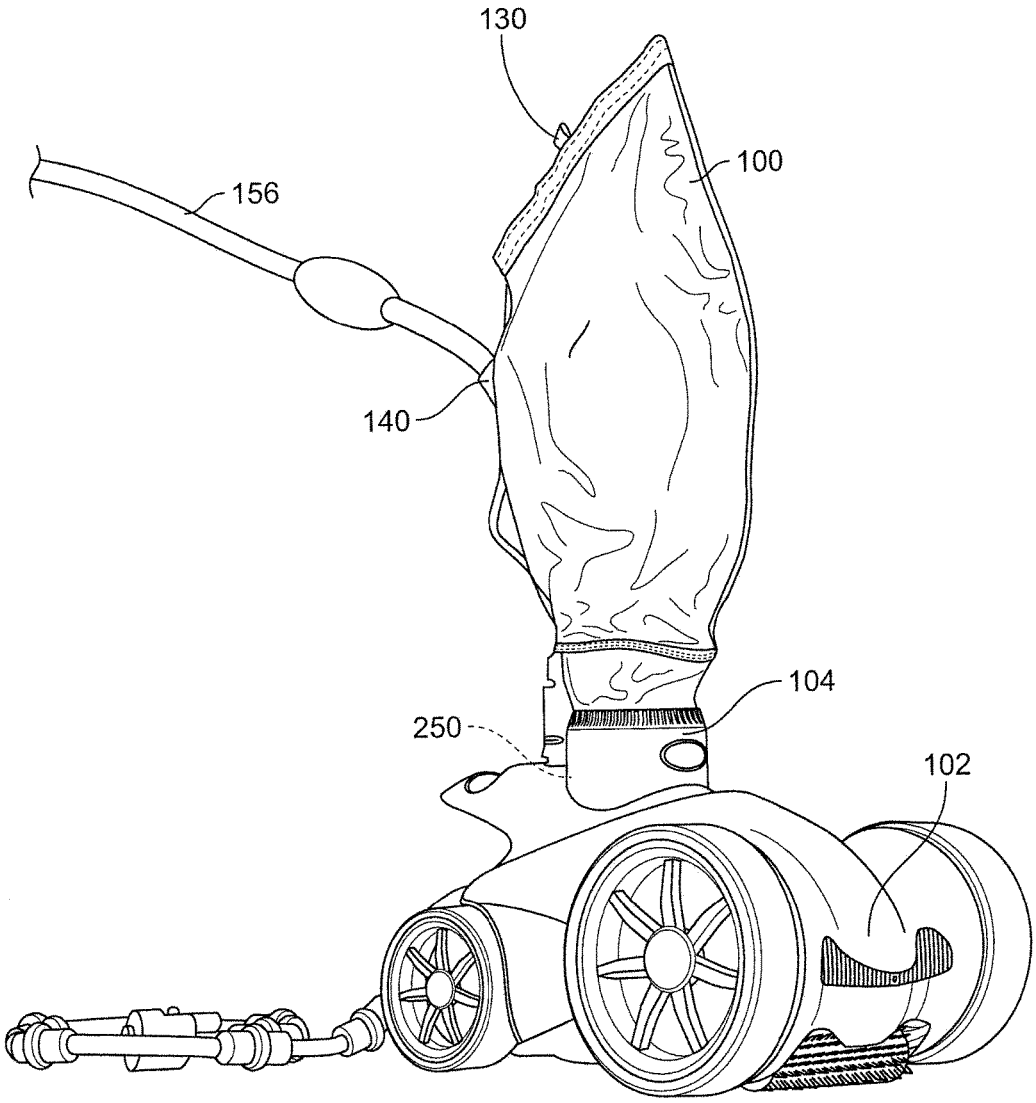
FIG. 1 is an isometric view of a pool cleaner having a debris bag coupled with a collar according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIGS. 1-9 illustrate a debris bag 100 according to one embodiment of the invention. The debris bag 100 is designed to be coupled to an outlet of a pool cleaner 102 via a collar 104, as shown in FIG. 1. The debris bag 100 is preferably coupled to the pool cleaner 102 prior to and during use to capture debris collected by the pool cleaner 102. After the pool cleaner 102 completes a cleaning cycle, the debris bag 100 may be removed from the pool cleaner 102 and/or removed from the collar 104 and emptied and/or replaced, as described below.

Figure 3:
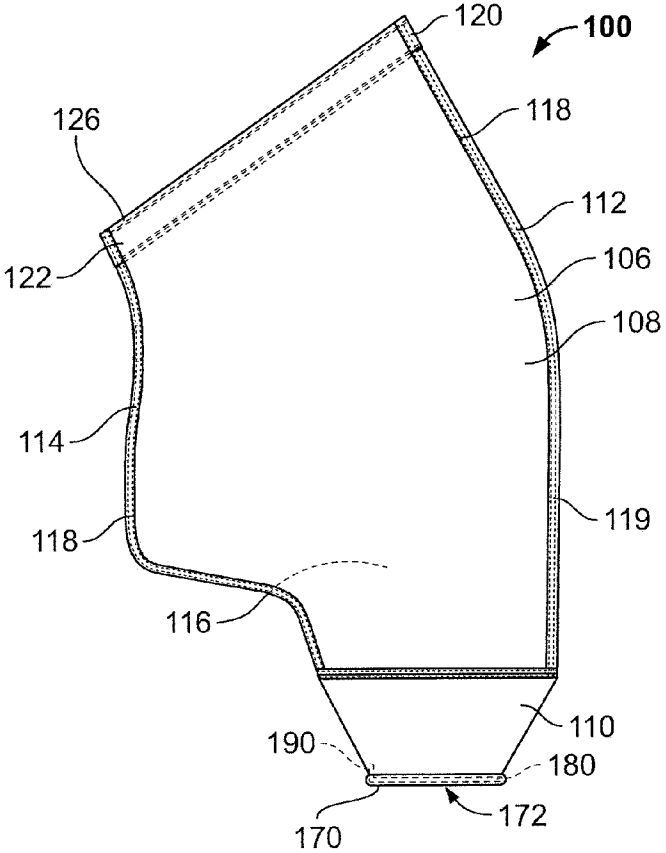
FIG. 3 is a front elevational view of the debris bag of FIG. 1.
Figure 2:
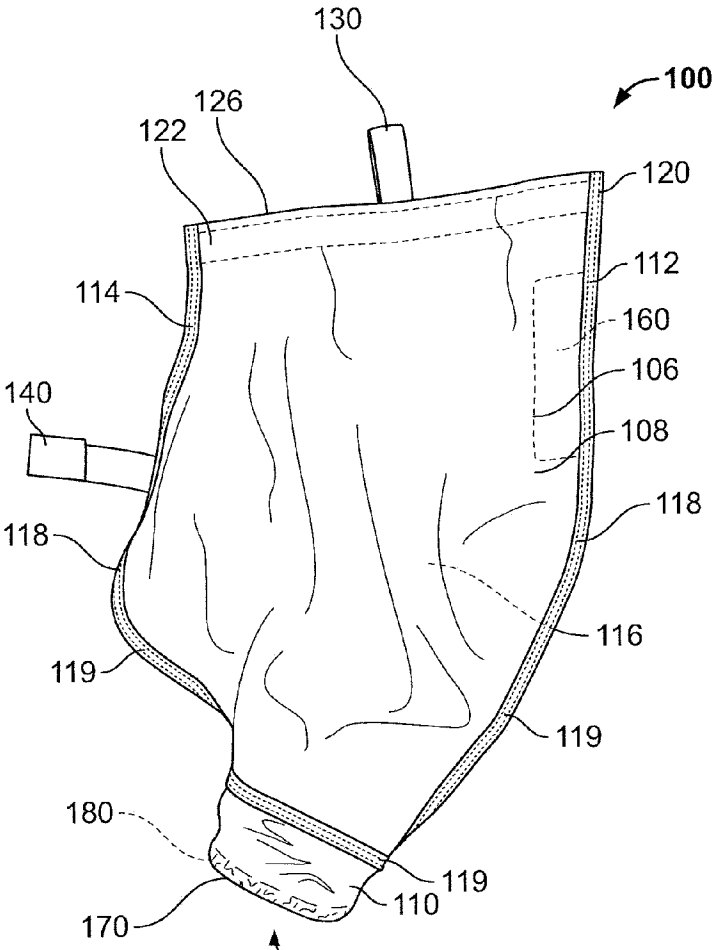
FIG. 2 is an isometric view of the debris bag of FIG. 1.
Figure 4:
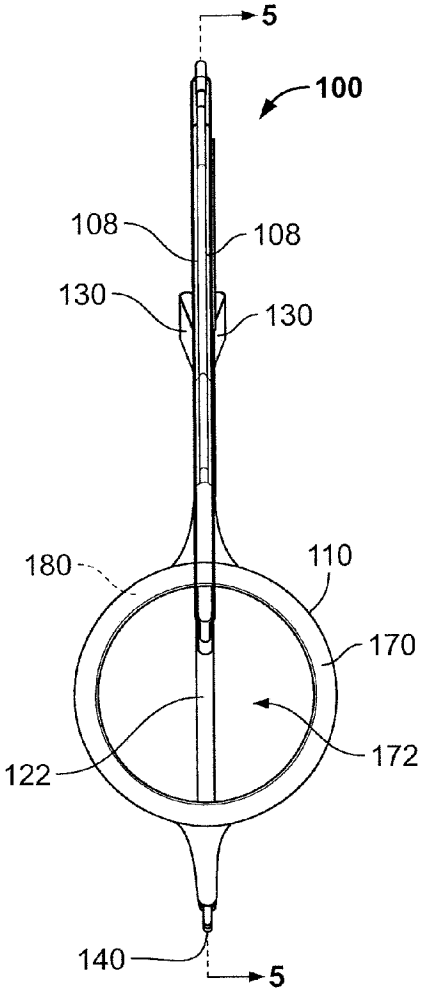
FIG. 4 is a bottom elevational view of the debris bag of FIG. 1.
Figure 6:
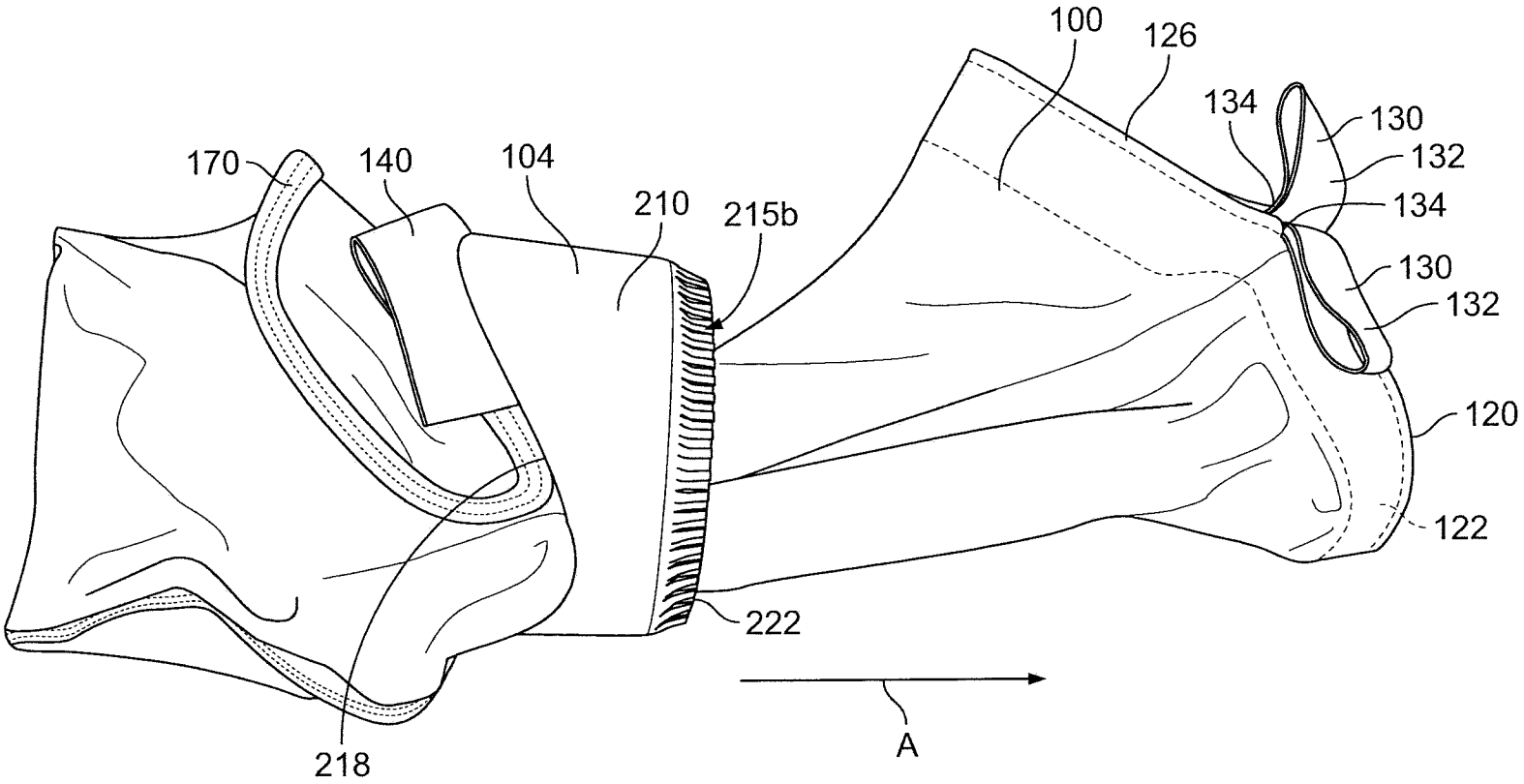
FIG. 6 is a top isometric view of the debris bag and the collar of FIG. 1 in an unattached position.

As shown in FIGS. 2-4, the debris bag 100 includes a body 106 defined by two opposing sheets 108 of fabric filtration media and a neck portion 110, which may be constructed of the same fabric filtration media as the opposing sheets 108, or different materials than the opposing sheets 108. In some embodiments, the neck portion may be formed from one or more materials that are waterproof or substantially prevent water from passing through the material. In other embodiments, the neck portion 110 may be constructed from one or more materials that allow some water to flow outwardly from the interior of the neck portion 110 back into the area around the pool cleaner 102.

The opposing sheets 108 of filtration media may be joined together via stitching 118 on one or more sides 112, 114, respectively, to define an interior compartment 116. The interior compartment 116 can be a single chamber large enough to accommodate debris from a swimming pool, such as leaves. In some embodiments, the portions of the opposing sheets joined together by the stitching 118 may be reinforced by a fabric tape 119 (see FIG. 2) that wraps around both sides of the joined area. The stitching 118 may pass through one or more (e.g., two) layers of the fabric tape 119, a portion of which may be positioned on the outer surfaces of one or more of the opposing sheets 108. In some embodiments, the fabric tape 119 may also reinforce attachment of the opposing sheets 108 to the neck portion 110. The fabric tape 119 may be constructed of different types of materials known to those having skill in the art.

In some embodiments, the debris bag 100 may be constructed of a single piece of filtration media that is folded over and stitched or otherwise attached on only one side (not shown). The filtration media may be a textile mesh material, such as, for example, fabric polyester. A top section 120 of the debris bag 100 includes a releasable attachment mechanism 122 that is designed to allow access to the interior compartment 116 of the debris bag 100. In one embodiment, the attachment mechanism 122 is two opposing strips of Velcro® (i.e., hook and loop) disposed on an interior portion of the opposing sheets 108 of filtration media adjacent to an upper edge 126 of the debris bag 100. In other embodiments, the attachment mechanism 122 may be a snap-fit mechanism or the like. In another embodiment, the top section 120 may be sealed to prevent access to the interior compartment 116 of the debris bag 100. In this embodiment, an opening (not shown) may be disposed in a side 112, 114 to allow access to the interior compartment 116. The opening (not shown) disposed in either side 112, 114 may also be secured via snap-fit, a Velcro® attachment, or the like.

Optionally, one or more looped handles 130 extend upwardly from the upper edge 126 of the debris bag 100. The looped handles 130 may comprise a single piece of fabric 132 that is joined to the debris bag 100 at opposing ends 134 (see FIG. 6). The handles 130 are designed to assist a user in opening the debris bag 100. In one embodiment, two looped handles 130 are disposed adjacent the upper edge 126 of the debris bag 100. The handles 130 may be sewn in between the attachment mechanism 122 and the sheet 108. In embodiments where the opening (not shown) is formed in either side 112, 114 of the debris bag 100, the looped handles 130 may be positioned adjacent the opening to assist a user in opening the debris bag 100.

Figure 7:
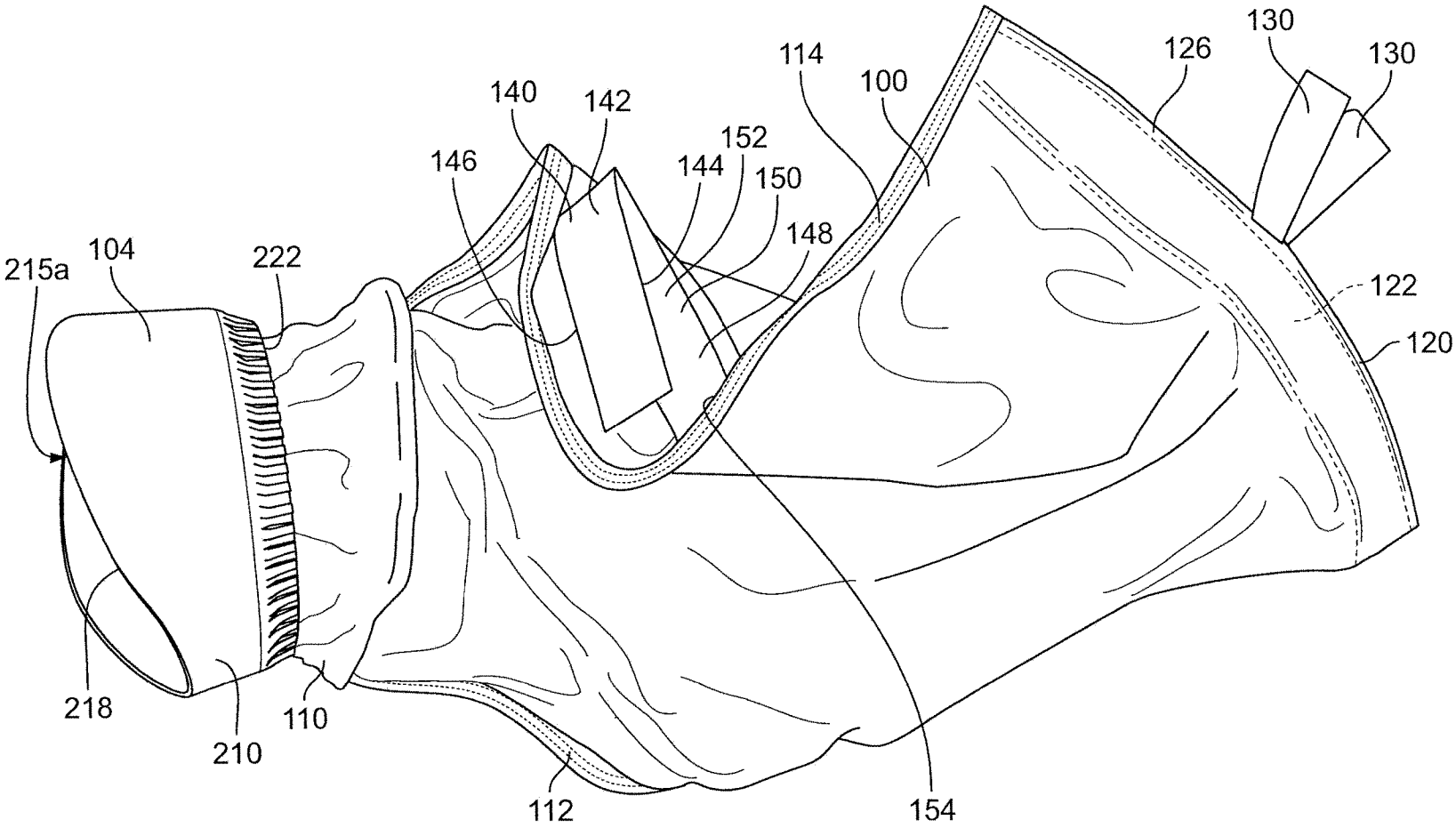
FIG. 7 is a top isometric view of the debris bag and collar of FIG. 1 in an attached position.

As shown in FIGS. 2 and 7, the debris bag 100 optionally includes a hose strap 140 that extends outwardly from the second side 114. The hose strap 140 includes a first section 142 having a hook pattern 144 on an interior surface 146 and a second section 148 having a loop pattern 150 on an exterior surface 152 (see FIG. 7). The first and second sections 142, 148 are joined to the second side 114 of the debris bag 100 at only one end 154 and the first section 142 is approximately twice the length of the second section 148. The hose strap 140 is designed to interact with a hose 156 of the pool cleaner 102 (see FIG. 1). In particular, the hose strap 140 extends around the hose 156 and is secured when the hook pattern 144 of the first section 142 contacts the loop pattern 150 of the second section 148. Attachment of the debris bag 100 to the hose 156 helps retain the debris bag 100 in an upright position during the cleaning cycle.

Figure 5:
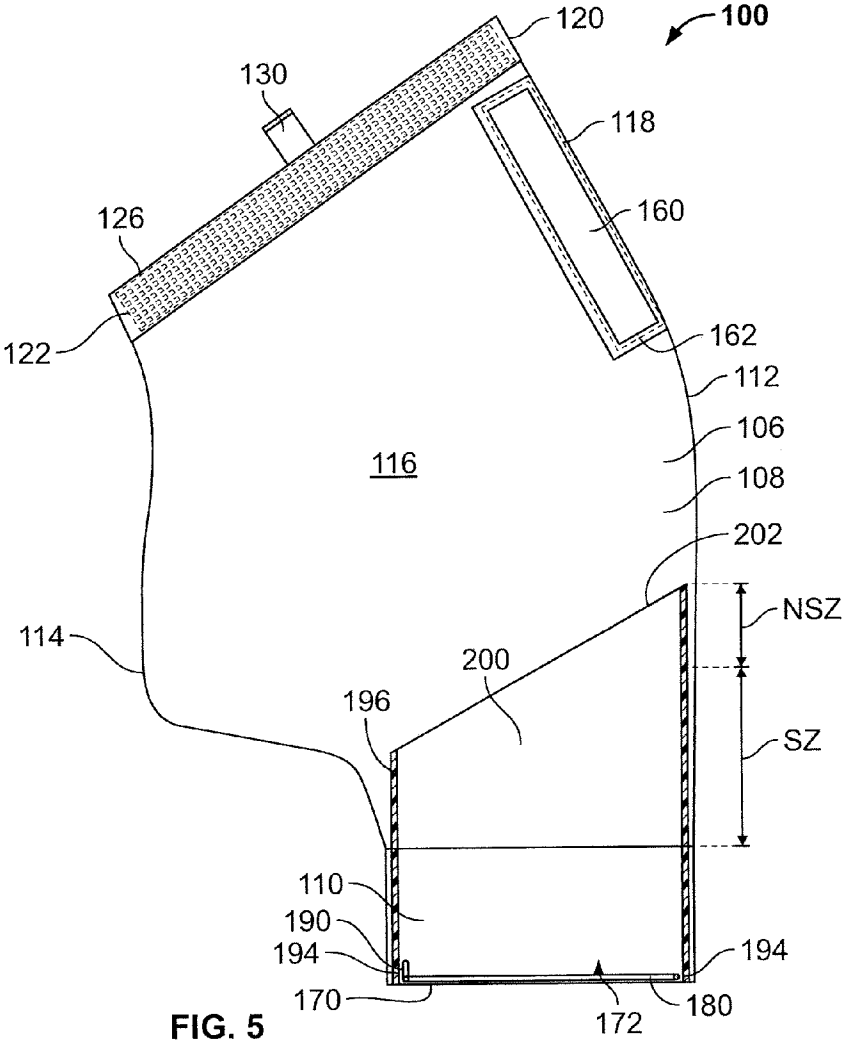
FIG. 5 is a cross-sectional view of the debris bag of FIG. 1 taken substantially along the line 5-5 in FIG. 4.

In some embodiments, the debris bag 100 also optionally includes a float 160, as shown in FIG. 5. The float 160 is preferably made from a material that helps keep the debris bag 100 in an upright position. In some embodiments, the float 160 is foam. The float 160 may be positioned on and/or in the debris bag 100 in any number of positions. For example, as shown in FIG. 5, the float 160 is disposed on the first side 112 of the debris bag 100 adjacent the upper edge 126. In some embodiments, the float 160 and the hose strap 140 work in conjunction with each other to retain the debris bag 100 in an upright position. In these embodiments, the float 160 and hose strap 140 are disposed on opposite sides of the debris bag 100. In other embodiments, the float 160 and hose strap 140 are disposed on the same side of the debris bag 100.

In the embodiment depicted in FIGS. 1-9, the float 160 is disposed in the interior compartment 116 of the debris bag 100. In this embodiment, the float 160 may be secured to the debris bag 100 using a pouch 162 (see FIG. 5) that is joined to the first side 112 via stitching 118. The pouch 162 may completely surround the float 160 to retain the float 160 in the desired position. In the embodiment depicted, the float 160 is made of a foam material and is provided in a rectangular shape.

As illustrated in FIGS. 1-9, the debris bag 100 further includes the neck portion 110 disposed adjacent a bottom end 170. The neck portion 110 is joined to the two opposing sheets 108 of fabric filtration media via stitching 118 that circumscribes the exterior of the opposing sheets 108 of filtration media. The neck portion 110 extends downwardly and defines a substantially circular opening 172 that allows access to the interior compartment 116.

The neck portion 110 further includes a substantially rigid circular support ring 180 (see FIG. 3) disposed adjacent the bottom end 170 of the debris bag 100. The support ring 180 may be sewn into the neck portion 110 such that the support ring 180 is enclosed by fabric of the neck portion 110. In other embodiments, the support ring 180 may be joined to the neck portion 110 in other manners. The support ring 180 assists in retaining the opening 172 in an open position and also interacts with the collar 104, as described more below. The support ring 180 may be made of one or more of polymers, rubbers, or other similar materials.

Figure 8:
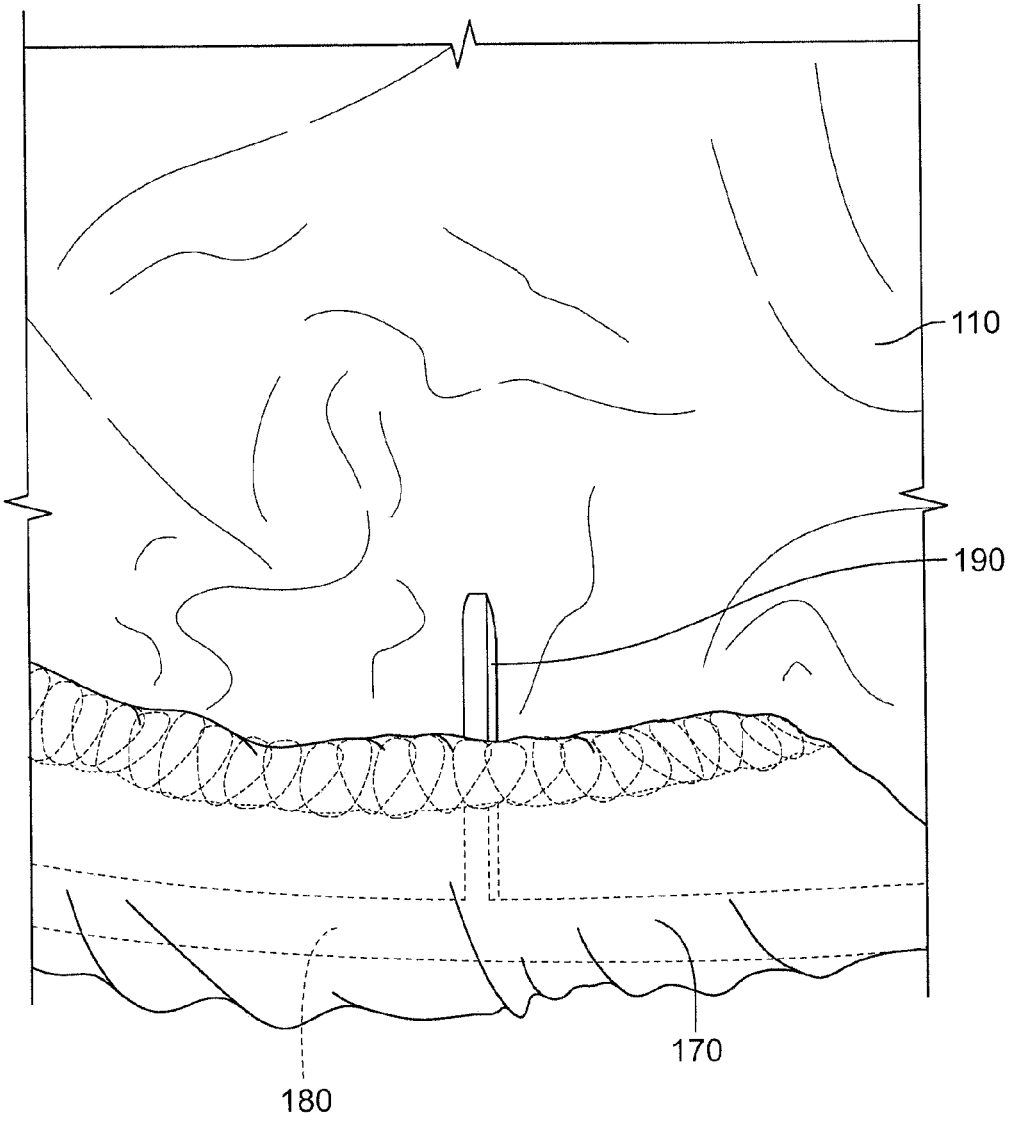
FIG. 8 is a partial isometric view of an orientation tab disposed inside of the debris bag of FIG. 1.

FIG. 8 illustrates an orientation tab 190 extending from the support ring 180 and into the neck portion 110 of the debris bag 100. The support ring 180 and the lower portion of the tab 190 are shown in broken lines for clarity. The tab 190 is in communication with and extends upwardly from the support ring 180 toward the interior compartment 116 of the debris bag 100. In one embodiment, the tab 190 is substantially exposed (e.g., not covered with fabric) and is attached at one end to the support ring 180. In other embodiments, the tab 190 is partially exposed (e.g., partially covered with fabric). The tab 190 assists a user in attaching the debris bag 100 to the collar 104, as described more below. In some embodiments, the tab 190 is provided as a substantially rectilinear plastic body. In other embodiments, the tab 190 may be provided in other shapes and/or sizes.

Figure 12:
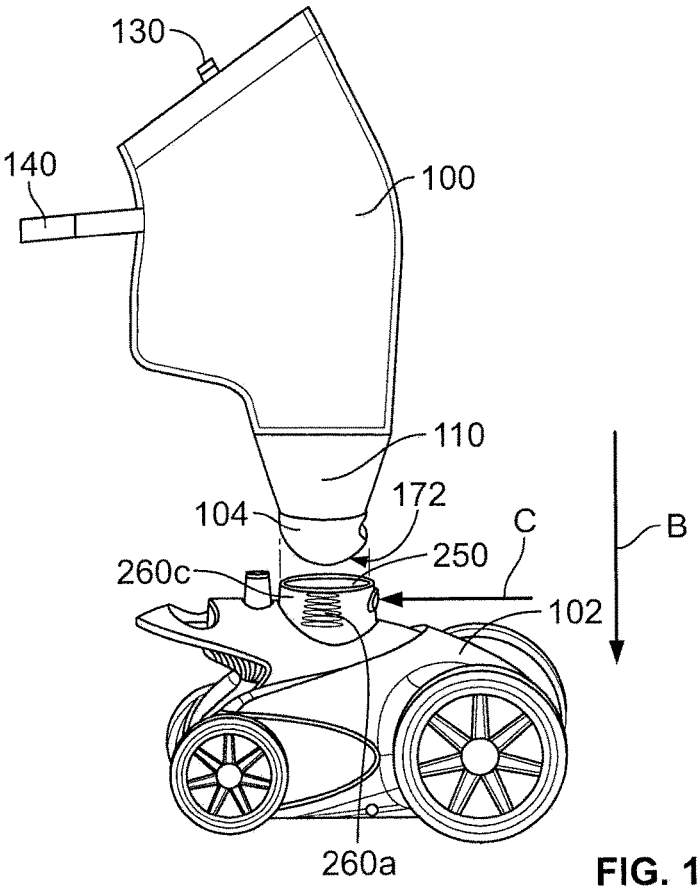
FIG. 12 is an isometric view of the pool cleaner and debris bag of FIG. 1 in an unsecured position.

The support ring 180 and the tab 190 are fixed in position with respect to the neck portion 110 of the debris bag 100. The tab 190 extends through the fabric of the neck portion 110 and thus prevents the rotation of the support ring 180 and the tab 190 within the neck portion 110. As can be seen in FIGS. 1 and 12, the debris bag 100 is positioned in relation to the cleaner 102 so that the wide profile of the debris bag 100 is substantially parallel to the direction of movement of the pool cleaner 102. In general, the debris bag 100 will travel through the water above the pool cleaner 102. This orientation helps to keep the debris bag 100 upright over the pool cleaner 102 so the flow of water around the pool cleaner 102 does not work to collapse or fold the debris bag 100 over. Thus, the tab 190 is not designed to rotate with respect to the neck portion 110 of the debris bag 100.

Figure 9:
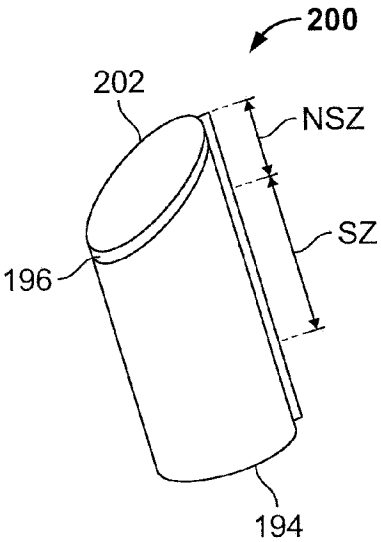
FIG. 9 is a isometric view of a sleeve disposed inside of the debris bag of FIG. 1.

As shown in FIGS. 5 and 9, the debris bag 100 also may include an inner sleeve 200. The inner sleeve 200 is disposed inside of the debris bag 100 and is attached at a lower end 194 to the neck portion 110 adjacent the opening 172. The lower end 194 may be attached to the neck portion 110 so that the tab 190 extends upwardly from the support ring 180 into the sleeve 200 and is at least partially visible to a user through the opening 172. The sleeve 200 is defined by a cylindrical body that extends upwardly partially into the interior compartment 116. The sleeve 200 is at least partially attached to the interior sidewall of the neck portion 110 to assist in retaining the sleeve 200 in an upright position.

In some embodiments, the sleeve 200 is also attached along a stitching portion (region SZ in FIGS. 5 and 9) of the first side 112 as part of the stitching 118 between the neck portion 110 and an upper end 202 of the sleeve 200. Additionally, at least a portion (see region NSZ in FIGS. 5 and 9) of the sleeve 200 adjacent an upper end 202 is detached from the debris bag 100 to allow the sleeve 200 to partially collapse. In some embodiments, the sleeve may be attached to the neck portion 110 only adjacent to the opening 172 and to the first side 112 between the top of the neck portion 110 and the upper end 202 of the sleeve 200 in the SZ region depicted in FIG. 5. Attaching a portion of the sleeve 200 to the first side 112 by stitching 118 further stabilizes the sleeve 200 to allow water and debris to more easily flow into the debris bag 100. The region SZ extends up the side of the sleeve 200 on the first side 112 of the debris bag 100 to at least the same height of an opposing short side 196. In some embodiments, the upper end 202 of the sleeve 200 is angled. Further, the sleeve 200 and/or neck portion 110 may include a coating on an interior surface, such as, for example, urethane. The sleeve 200 may also be formed from a single piece of fabric that is the same material as the neck portion 110.

When the debris bag 100 is attached to the pool cleaner 102 and the pool cleaner 102 is undergoing a cleaning cycle, water and debris is pulled into the pool cleaner 102, upward through the neck portion 110 and the sleeve 200, and into the interior compartment 116. In this cycle, water and debris push through the sleeve 200, which helps retain the sleeve 200 in an upright and at least partially open position whereby the debris is unobstructed and able to pass into the interior compartment 116. When the pool cleaner 102 is finished with the cleaning cycle, or otherwise shut off, water and debris does not flow into the pool cleaner 102 or debris bag 100 and the sleeve 200 at least partially collapses to inhibit debris from exiting the debris bag 100. In some embodiments, the sleeve 200 collapses to obstruct the opening 172 greater than 90%. In other embodiments, the sleeve 200 collapses to obstruct the opening 172 at least 75%.

In some embodiments, the neck portion 110 and the sleeve 200 are formed from substantially water impermeable fabric and/or are coated with a surface treatment to prevent the passage of water. When the pool cleaner 102 is shut off and removed, any water within the interior compartment 116 that is directed toward the opening 172 may push against the sleeve, 200 further causing it to collapse and obstruct the opening 172 to prevent debris from escaping out through the opening 172. Further, the neck portion 110 may act to retain some quantity of water as the pool cleaner 102 is detached from the debris bag 100. Any water retained in the debris bag 100 may also help to collapse the sleeve 200 and retain debris in the debris bag 100.

Figure 10:
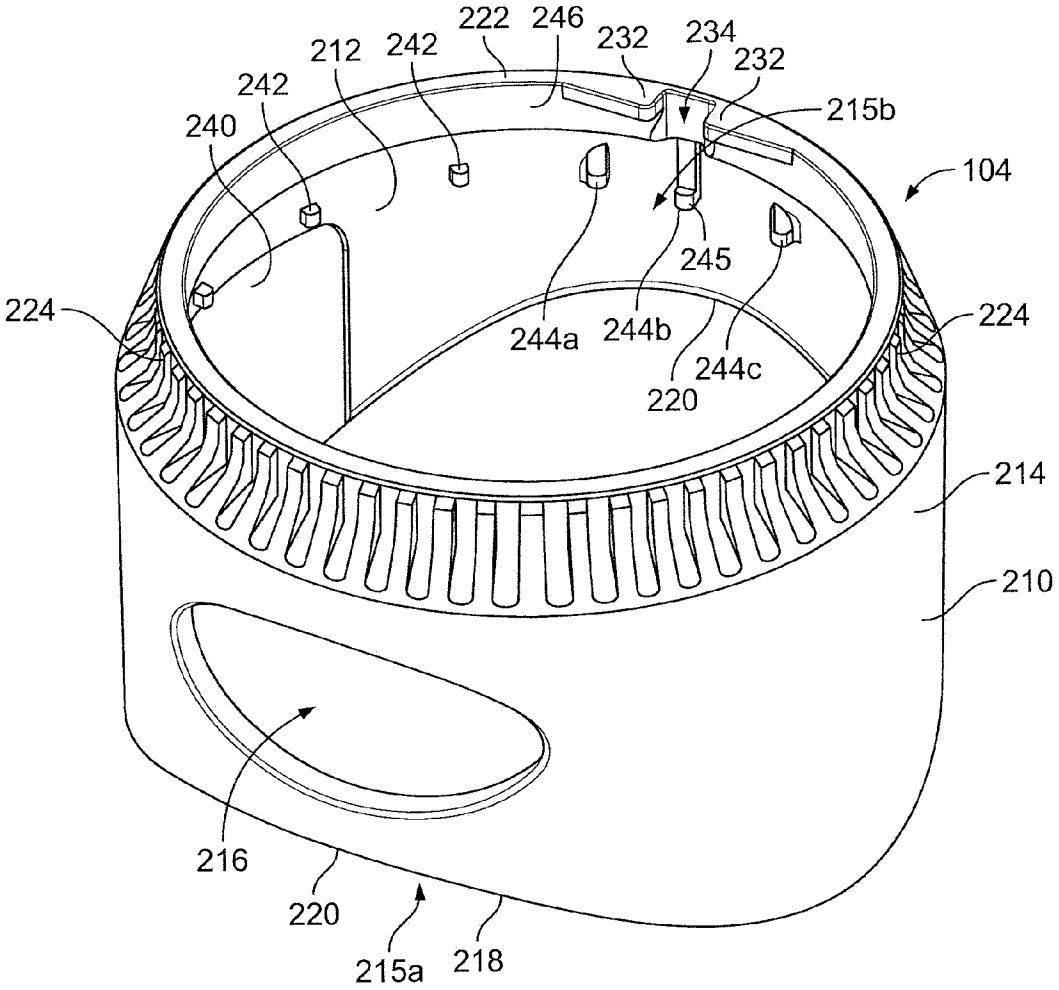
FIG. 10 is a top isometric view of the collar of FIG. 1.
Figure 11:
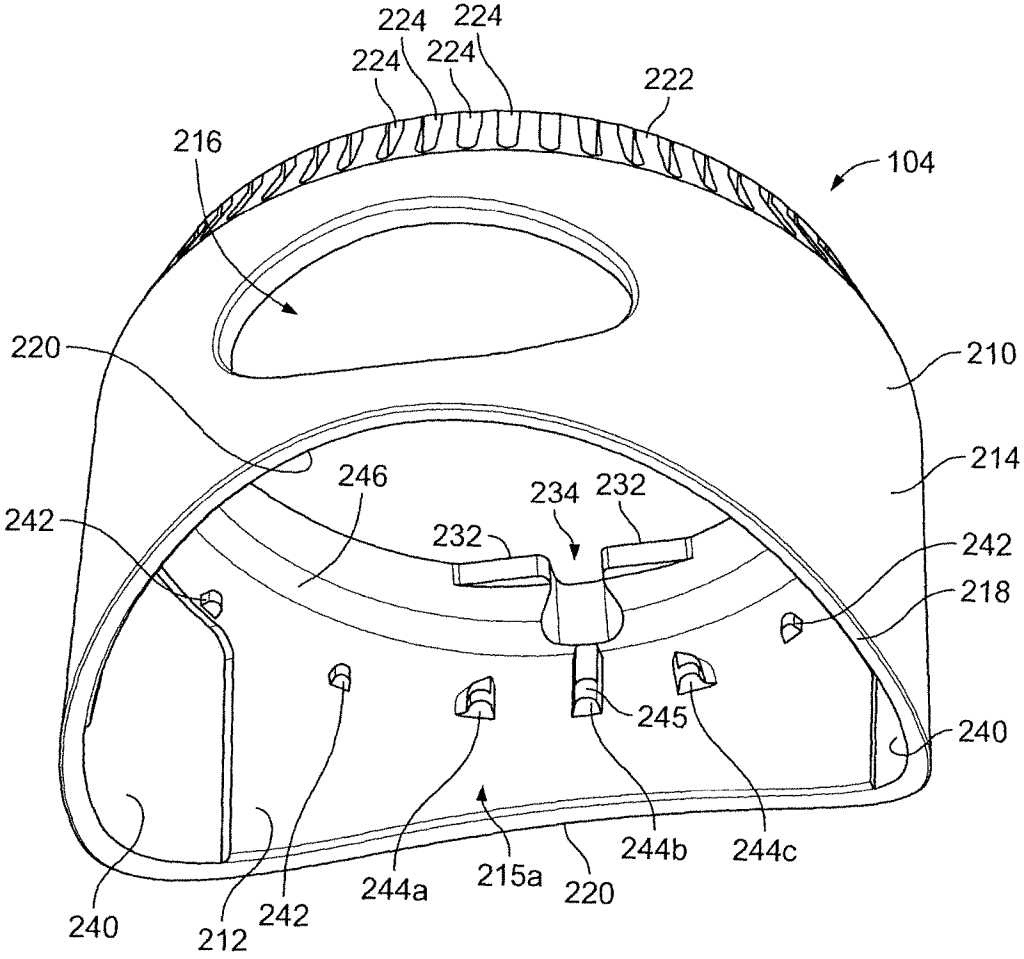
FIG. 11 is a bottom isometric view of the collar of FIG. 1.

The debris bag 100 is designed to be releasably coupled to the collar 104. As shown in FIGS. 10 and 11, the collar 104 is defined by a substantially cylindrical body formed by a sidewall 210 having an interior surface 212 and an exterior surface 214. The sidewall 210 defines a lower inlet 215*a* and an upper outlet 215*b* that are in communication with the pool cleaner 102 and the debris bag 100, respectively. The sidewall 210 is rigid and, in some embodiments, is a polymer. The sidewall 210 is interrupted by an oval opening 216 adjacent the lower inlet 215*a* that extends entirely through the sidewall 210. The lower inlet 215*a* is designed to interact with a portion of the pool cleaner 102, as explained in more detail below, to retain the collar 104 and the debris bag 100 on the pool cleaner 102.

The sidewall 210 of the collar 104 is curved upwardly adjacent a lower edge 218 on opposing sides 220. As shown in FIG. 11, the curvature of the sidewall 210 is more pronounced on the portion of the sidewall 210 that does not include the opening 216. The sidewall 210 is also slightly stepped and tapers inwardly adjacent an upper edge 222 and includes a plurality of vertical indentations 224 on the exterior surface 214.

The upper edge 222 of the sidewall 210 also includes two opposing substantially triangular notches 232 extending inwardly from the upper edge 222. A substantially C-shaped channel 234 is cut into the sidewall 210 between the notches 232 and is designed to receive the orientation tab 190 of the debris bag 100.

FIG. 11 illustrates the interior surface 212 of the collar 104 that includes two slightly recessed sections 240 that are on opposing sides of the sidewall 210. The recessed sections 240 are shaped to accommodate a portion of the pool cleaner 102, described in more detail below.

The collar 104 also includes a plurality of primary protrusions 242 that circumscribe the interior surface 212 of the sidewall 210. The primary protrusions 242 are spaced from each other and protrude outwardly from the interior surface 212 of the sidewall 210. In some embodiments, the primary protrusions 242 extend outwardly from the sidewall 210 a distance between about 0.01 mm to about 1 mm. In one embodiment, the sidewall 210 includes about 12 primary protrusions 242. Three additional secondary protrusions 244*a*-244*c* also extend from the interior surface 212 of the sidewall 210 adjacent the channel 234. The additional secondary protrusions 244*a*-244*c* extend from the sidewall 210 of the collar 104 a distance greater than that of the primary protrusions 242. One of the secondary protrusions 244*b* is designed to interact with the orientation tab 190 and the support ring 180 of the debris bag 100. The protrusion 244*b* includes a stop 245 that is positioned at a lower end of the protrusion 244*b*. The stop 245 extends slightly below the support ring 180 when the orientation tab 190 is positioned within the channel 234.

As illustrated in FIG. 11, the interior surface 212 of the collar 104 also includes a circular groove 246 shaped and sized to accommodate the support ring 180 of the debris bag 100. The groove 246 circumscribes the interior surface 212 of the sidewall 210 between the upper outlet 215*b* and the protrusions 242, 244 and is generally positioned adjacent the upper edge 222 of the collar 104.

Figure 13:
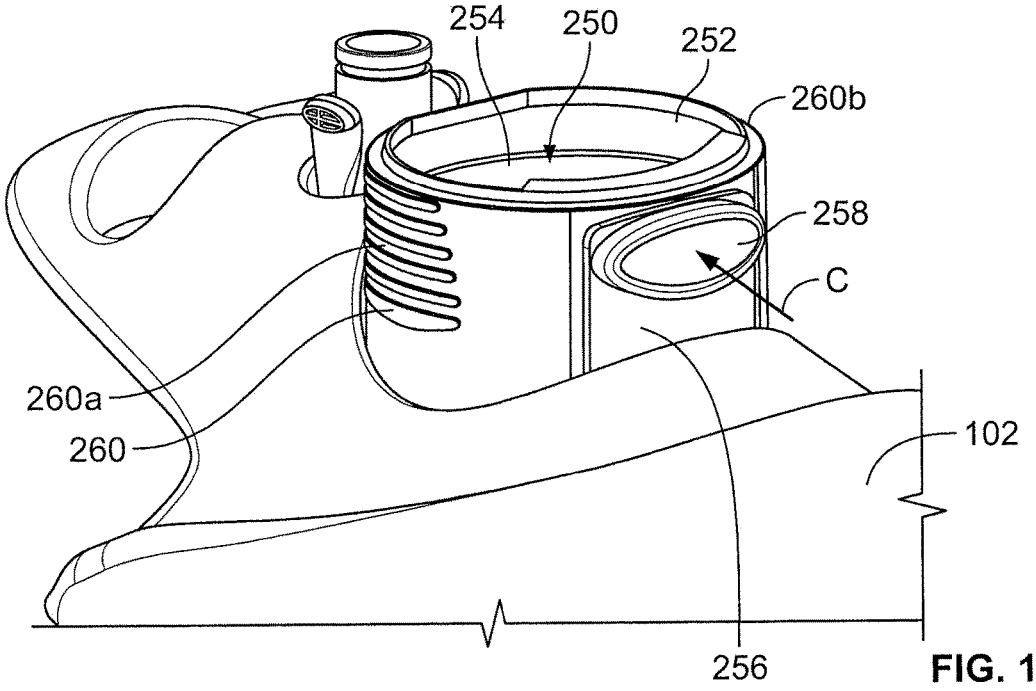
FIG. 13 is a partial isometric view of an outlet of the pool cleaner.

Now turning to FIGS. 12 and 13, the opening 172 of the debris bag 100 can be coupled to and is in communication with an outlet 250 of the pool cleaner 102 via the collar 104. As a result, when debris exits the pool cleaner 102 at its outlet 250, debris can travel through the opening 172 and can be captured inside the interior compartment 116 of the debris bag 100.

As depicted in FIG. 13, the outlet 250 of the pool cleaner 102 is defined by a substantially cylindrical body 252 forming a cavity 254 that extends through the pool cleaner 102. The cylindrical body 252 includes a hinged flexible tab 256 with a raised ledge 258 that corresponds to the shape of the oval opening 216 of the collar 104. The hinged tab 256 is attached to the body 252 and includes a hinged portion (not shown) that allows the tab 256 to be pushed inwardly toward the cavity 254.

The body 252 of the outlet 250 also includes a plurality of horizontal ribs 260 that circumscribe the exterior surface of the body 252. In some embodiments, the ribs 260 are disposed on three portions of the body 252. In particular, a first set of ribs 260*a* and a second set of ribs 260*b* are disposed on opposing sides of the tab 256. Additionally, a third set of ribs 260*c* is disposed on the body 252 in between the first set of ribs 260*a* and the second set of ribs 260*b* opposite the tab 256. In one embodiment, the first set and second set of ribs 260*a*, 260*b* include about six individual ribs 260. The ribs 260 are sized to correspond to the recessed sections 240 of the collar 104 such that interference is created between the outlet 250 and the collar 104 when joined together. In some embodiments, the first set of ribs 260*a* and the second set of ribs 260*b* prevent the rotation of the collar 104 during installation by way of the interaction with the recessed sections 240 on the interior surface 212 of the collar 104. Further, in some embodiments, the lower edge 218 of the collar 104 may be curved to match the contours of the intersection of an outer surface of the pool cleaner 102 and the cylindrical body 252 of the outlet 250. The curvature of the lower edge 218 assists in positioning the collar 104 in the correct alignment for proper attachment to the cylindrical body 252 of the pool cleaner 102.

The component parts having been described, the methods of connection, and methods of use of the debris bag 100, collar 104, and pool cleaner 102 will now be discussed in greater detail. In particular, the debris bag 100 must be attached to the collar 104 in order to have the capability to be properly attached to the pool cleaner 102.

Figure 14:
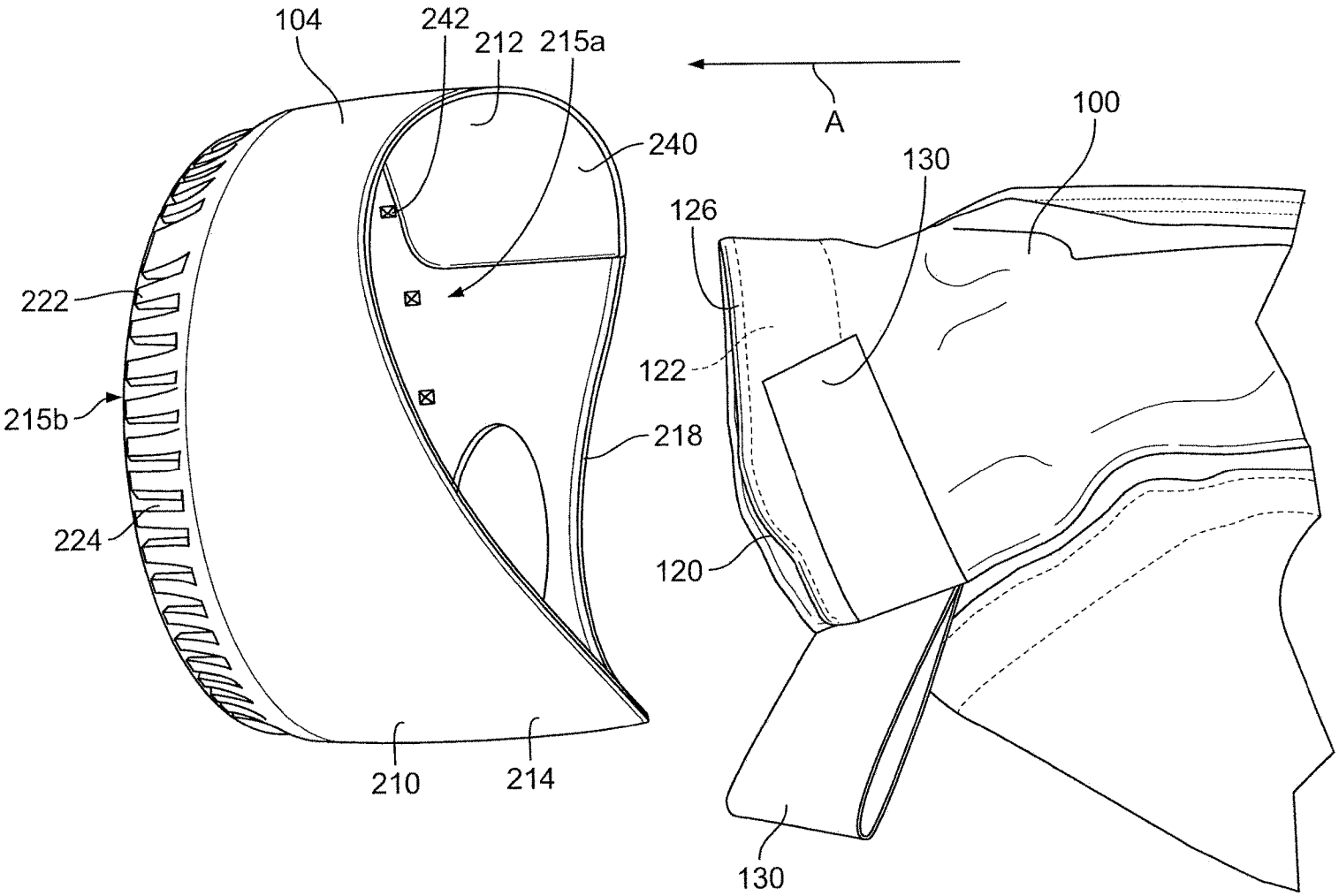
FIG. 14 is a top isometric view of the debris bag and collar of FIG. 1 being aligned prior to coupling.
Figure 15:
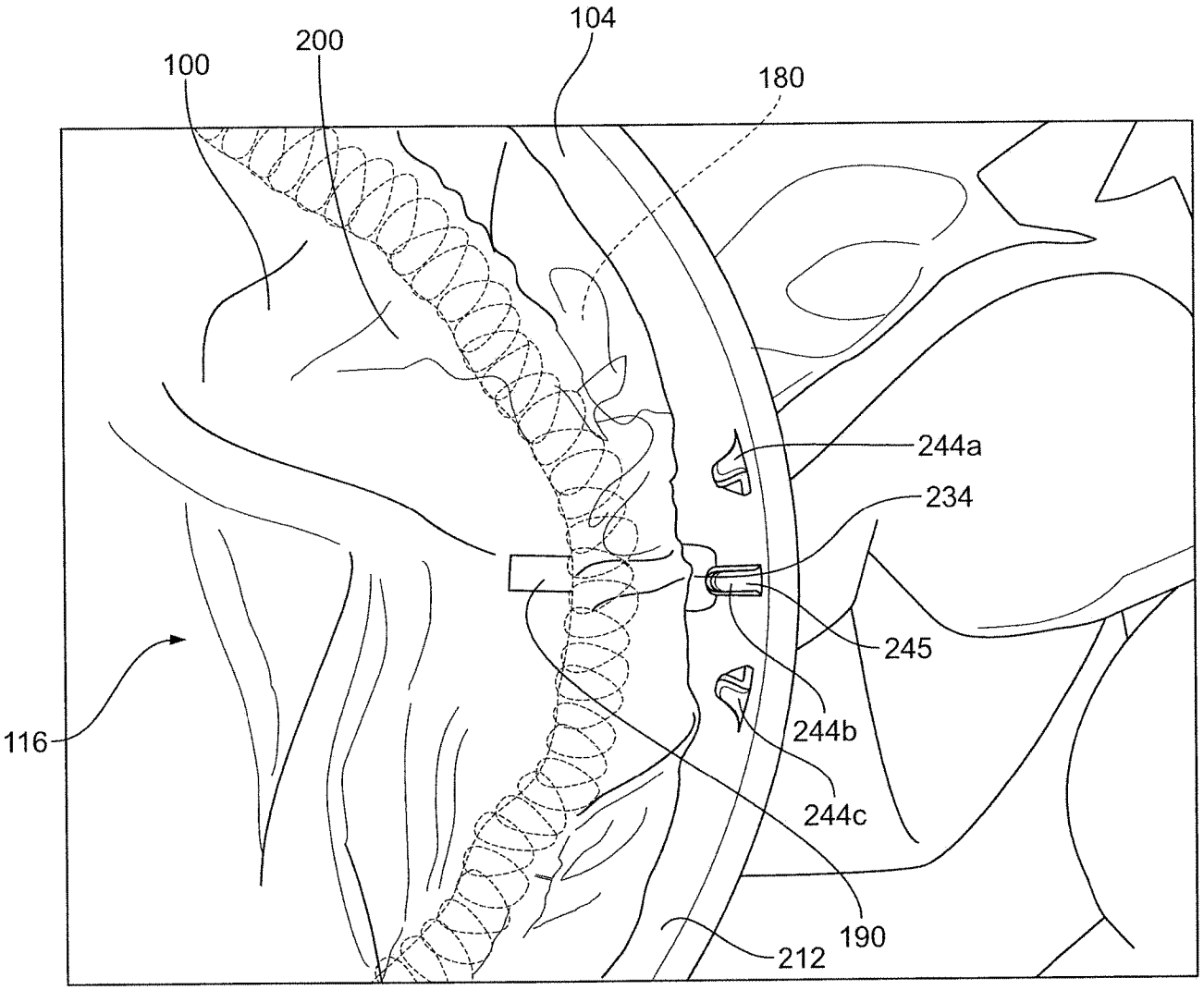
FIG. 15 is a top isometric view of the debris bag sliding into the collar of FIG. 1.

FIGS. 6, 7, 14, and 15 depict a method to attach the debris bag 100 to the collar 104. In particular, to attach the debris bag 100 to the collar 104, the upper edge 126 of the debris bag 100 is positioned adjacent the lower edge 218 of the collar 104 as shown in FIG. 14. The debris bag 100 may be crumpled or otherwise folded to allow the debris bag 100 to slide more easily through the collar 104. Once positioned, the debris bag 100 should be pulled by the upper edge 126 and/or one or more of the looped handles 130 toward the lower inlet 215*a* and interior of the collar 104 and upwardly through the upper outlet 215*b* in the direction depicted by arrow A (See FIGS. 6 & 14). As the debris bag 100 is being pulled through the collar 104, the orientation tab 190 of the debris bag 100 is aligned with the channel 234 of the collar 104 as shown in FIG. 15. If the orientation tab 190 is not aligned with the channel 234, the debris bag 100 will not be able to be secured to the collar 104 due to the orientation tab 190 catching on the interior surface 212 of the collar 104.

As the debris bag 100 continues through the collar 104, the support ring 180 of the debris bag 100 rides over the primary and secondary protrusions 242, 244 on the interior surface 212 of the collar 104 and the support ring 180 contacts and snaps into the groove 246 adjacent the upper outlet 215*b* of the collar 104. Depending on the rigidity of the protrusions 242, 244, and/or the support ring 180, pressure may be applied to the support ring 180 to assist in securing the support ring 180 into the groove 246. To add additional stability, the secondary protrusion 244*b* projects outwardly adjacent the orientation tab 190. In this way, the support ring 180, and thus, the debris bag 100, can be releasably connected to the collar 104 when the support ring 180 is held in the groove 246 by the protrusions 242, 244.

FIG. 12 depicts a method for attaching the debris bag 100/collar 104 to the pool cleaner 102. In particular, after the debris bag 100 is secured to the collar 104, the debris bag 100 can be attached to the outlet 250 of the pool cleaner 102. To attach the debris bag 100, the collar 104 should be positioned directly above the outlet 250 and substantially aligned. The alignment should include positioning the recessed sections 240 over the ribs 260*a*, 260*b* and the opening 216 in a substantially vertical position above the tab 256. The collar 104 may then be moved downwardly toward the outlet 250 in the direction represented by arrow B.

As the collar 104 is moved downwardly, the opening 216 of the collar 104 should be aligned with the ledge 258 of the outlet 250. Once the collar 104 is adjacent the flexible tab 256, inward pressure represented by arrow C may be applied to the ledge 258 to push the tab 256 inwardly. As the same time, the collar 104 can be slid downward onto the outlet 250. Once the collar 104 is in position, the flexible tab 256 may be released, which causes the ledge 258 to protrude through the opening 216 of the collar 104 and the debris bag 100 to be releasably attached to the pool cleaner 102. Additionally, at least some of the ribs 260 of the outlet 250 contact the recessed sections 240 of the interior surface 212 of the collar 104 to create additional interference. In some embodiments, the downward pressure of the collar 104 onto the flexible tab 256 via the interior surface 212 of the collar 104 acting on the ledge 258 may be enough to deflect the ledge 258 to allow the collar 104 to pass over and seat properly with the ledge 258 extending through the opening 216 without supplying additional inward pressure C on the ledge 258.

To remove the collar 104/debris bag 100 from the pool cleaner 102, the ledge 258 is pressed inwardly, which causes the flexible tab 256 to move inwardly. At the same time, the collar 104/debris bag 100 may be pulled upwardly off the outlet 250. To release the debris bag 100 from the collar 104, inward pressure may be applied to the orientation tab 190 of the debris bag 100 adjacent the neck portion 110 toward the upper outlet 215*b* of the collar 104. The support ring 180 may be slightly deformed to allow the support ring 180 to partially exit the groove 246 below the protrusions 244 adjacent the orientation tab 190. Pressure can be applied to remove the remaining portions of the support ring 180 from the groove 246 by grasping the neck portion 110 and pressing into the upper outlet 215*b*. The neck portion 110 of the debris bag 100 may be pushed through the upper outlet 215*b* of the collar 104, which causes the support ring 180 to disengage with the groove 246 and ride up over the protrusions 242, 244. The neck portion 110 and the support ring 180 will then be able to move freely within the collar 104.

A substantially full debris bag 100 having a large amount of debris within the interior compartment 116 may not fit back through the collar 104. Instead, the support ring 180 may be rotated about 90 degrees and pulled through the upper outlet 215*b*. The support ring 180 may need to be slightly deformed to pass through the upper outlet 215*b*. In this way, a new debris bag 100 may be used with an existing collar 104.

Alternatively, the debris bag 100 that was removed from the pool cleaner 102 may be emptied by pulling the looped handles 130 apart and opening the releasable attachment mechanism 122. Debris within the interior compartment 116 can be removed and the attachment mechanism 122 closed. The debris bag 100, now emptied, may be reinstalled onto the collar 104 as previously described. Alternatively, the support ring 180 may be reinserted into the collar 104 by reversing the process just disclosed. Placing the support ring 180 at about a 90 degree angle to the upper outlet 215*b* and pressing into the collar 104 may deform the support ring 180 enough to allow it to pass through the upper outlet 215*b*. Once the support ring is below the protrusions 242, 244 the process described earlier can be followed to reattach the same, or a different, debris bag 100 to the collar 104.

The debris bag 100 can be used with a pressure-side pool cleaner 102. Pressure side pool cleaners 102 generally depend on a venturi system to move debris with the help of moving water from the bottom of the pool through a vacuum tube to the outlet 250 and into the debris bag 100. The water can then flow out of the debris bag 100, while the debris remains inside the debris bag 100. Any restriction to the flow generated by venturi system, such as water being restricted from flowing out of the debris bag 100, reduces the speed of water, and thus, reduces the amount of debris pick up.

When the debris bag 100 is full, it can be separated from the pool cleaner 102 and the collar 104, as described above, and emptied. After a time period in which the debris bag 100 is worn, the worn debris bag 100 may be replaced with a new debris bag 100 and attached to the collar 104. The same collar 104 may be used for both the worn debris bag 100 and the new debris bag 100, thus saving the user money by reusing a part of the debris bag 100 (i.e., the collar 104). In some instances, debris bags 100 having various different volumetric capacities may be used with the same collar 104.

In some instances, the debris bag 100 and/or collar 104 may be sold with the pool cleaner 102. In other instances, the debris bag 100 and collar 104 may be sold together, separate from the pool cleaner 102, as a replacement kit. Additionally, the debris bag 100 and the collar 104 may be sold separately.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A debris bag for a pool cleaner, the debris bag comprising:

a body defined by two opposing sheets of filtration media and joined together to form an interior compartment;

a neck portion extending downwardly from the sheets;

a support ring disposed adjacent a bottom end of the neck portion; and an orientation tab extending upwardly from the support ring toward the interior compartment.

2. The debris bag of claim 1 further including a releasable attachment mechanism disposed adjacent an upper edge of the debris bag.

3. The debris bag of claim 2, wherein the releasable attachment mechanism is provided in the form of a hook and a loop arrangement.

4. The debris bag of claim 1 further including at least one handle extending from an upper edge of the debris bag.

5. The debris bag of claim 1 further including two looped handles extending from an upper edge of the debris bag on opposing sides of the debris bag.

6. The debris bag of claim 1 further including a float disposed in a pouch in the interior compartment.

7. The debris bag of claim 1 further including a strap extending outwardly from the debris bag that is designed to secure a hose associated with the pool cleaner to the debris bag.

8. A debris bag assembly for a pool cleaner, the debris bag assembly comprising:

a debris bag having a body defined by filtration media that forms an interior compartment, and a neck portion having a support ring; and a collar defined by a sidewall having a groove and a plurality of protrusions on an interior surface, wherein the groove receives the support ring of the debris bag and the plurality of protrusions contact the support ring to couple the debris bag to the collar.

9. The debris bag assembly of claim 8 further including a channel disposed in the sidewall of the collar adjacent an upper edge.

10. The debris bag assembly of claim 9 further including an orientation tab extending upwardly from the support ring toward the interior compartment of the debris bag.

11. The debris bag assembly of claim 10, wherein the channel is sized to receive the orientation tab.

12. The debris bag assembly of claim 8, wherein the debris bag further includes a sleeve that extends from the support ring upwardly toward the interior compartment.

13. The debris bag assembly of claim 12, wherein the sleeve is substantially erect when water is flowing into the debris bag.

14. The debris bag assembly of claim 12, wherein the sleeve substantially obstructs an opening of the neck portion when water is not flowing into the debris bag.

15. A method of attaching a debris bag to a collar, comprising the steps of:

providing the debris bag having a body having an upper edge, and a neck portion with a support ring;

providing a collar having a sidewall with a lower edge, and a groove and a plurality of protrusions disposed on an interior surface of the sidewall;

positioning the upper edge of the debris bag adjacent the lower edge of the collar; and pulling the debris bag through the collar until the support ring rides over the plurality of protrusions and contacts the groove.

16. The method of claim 15, wherein the debris bag further includes an orientation tab and the collar includes a channel.

17. The method of claim 16 further including the step of aligning the orientation tab and the channel as the debris bag is being pulled through the collar.

18. The method of claim 15 including the step of disengaging the debris bag from the collar by removing the support ring from the groove.

19. The method of claim 18 including the step of attaching a second, different debris bag to the collar.

20. The method of claim 15 including the step of attaching the debris bag and collar to a pool cleaner.

* * * * *